US007055420B1

(12) United States Patent
Lois

(10) Patent No.: US 7,055,420 B1
(45) Date of Patent: Jun. 6, 2006

(54) FRIENDLY FIRE AVOIDANCE/SELF-DEFENSE SYSTEM

(76) Inventor: William Lois, 2233 E. 65th St., Brooklyn, NY (US) 11234

( * ) Notice: Subject to any disclaimer, the term of this patent is extended or adjusted under 35 U.S.C. 154(b) by 601 days.

(21) Appl. No.: 10/304,099

(22) Filed: Nov. 25, 2002

(51) Int. Cl.
*B64D 1/04* (2006.01)
*G01S 13/78* (2006.01)

(52) U.S. Cl. ..... 89/1.1; 89/1.11; 342/45

(58) Field of Classification Search ..... 89/1.11, 89/1.1; 342/45; 102/501, 221
See application file for complete search history.

(56) References Cited

U.S. PATENT DOCUMENTS

| | | | | |
|---|---|---|---|---|
| 5,796,362 | A * | 8/1998 | Ayasli et al. | 342/6 |
| 6,025,795 | A * | 2/2000 | Hulderman et al. | 342/45 |
| 6,437,727 | B1 * | 8/2002 | Lemelson et al. | 342/45 |
| 6,664,915 | B1 * | 12/2003 | Britton | 342/45 |
| 6,914,518 | B1 * | 7/2005 | Gerber et al. | 340/10.4 |

* cited by examiner

*Primary Examiner*—J. Woodrow Eldred
(74) *Attorney, Agent, or Firm*—Michael I. Kroll

(57) ABSTRACT

The invention is a defense system whereby all primary delivery weapons systems with some types of communications systems will be able to identify friends from foes and with the ability to take appropriate actions afterward so that no harm will come to friendly assets.

12 Claims, 9 Drawing Sheets

FRIENDLY FIRE AVOIDANCE/SELF-DEFENSE SYSTEM

BACKGROUND OF THE INVENTION

1. Field of the Invention

The present invention relates generally to weapons systems and, more specifically, to a self-defense and avoidance of friendly fire of primary delivery weapons systems.

2. Description of the Prior Art

There are other systems designed for self-defense measures and friendly fire avoidance.

There are other communications systems that provide for identifying friends and foes. While these systems may be suitable for the purposes for which they were designed, they would not be as suitable for the purposes of the present invention as heretofore described.

It is thus desirable to provide communication systems with rapid automatic reaction in tactical and strategical situations. It is further desirable to endow such systems with the capabilities to self-defeat internal guidance and/or firing mechanisms.

SUMMARY OF THE PRESENT INVENTION

The system envisions all primary delivery weapons systems with some types of communications systems so as to be able to identify friends from foes and with the ability to take appropriate actions afterward so that no harm will come to the friendlies.

It is suggested that a friendly manned position have a transmitter that transmits constantly, to which any active delivery weapon is programmed to listen. However, this is akin to having a bonfire started in the middle of the night in a hostile territory. Although both the primary weapons and any friendly assets need to have transmitting and receiving capabilities (transceivers), it is the primary weapons that need to be actively broadcasting. Besides, in all cases, such broadcasting needs to be discrete.

Indiscriminate response and transmission of an instruction to self-defeat upon receiving a broadcast from such a weapon will result in disabling friendly as well as hostile weapons alike. Therefore, a way of discriminating friendly weapons from the hostile ones needs to be found. Although it is possible to equip such self-defeat devices only on the weapons systems that are sold to outsider, who may turn out to be hostile in the future, this method will only be successful in a very limited sense.

For example, the weapons sold to friendly parties should not be disabled by accident. There may be friendly parties as well as hostile ones using the same kind of weapons in a battle, in which case distinction between the two groups must be made. Friendly weapons can be captured and used by a hostile party. Hostile party's weapons may be seized, and need to be used against them.

So it is most reasonable to equip such self-defeat devices on all weapons system regardless of who may end up having them. It is in time of conflict, therefore, that the various weapons, those in friendly hands and those in the hands of a hostile party, need to be distinguished in order to take the appropriate action.

The concept of preventing mishap between friendly participants in a conflict, and even in peacetime exercises, is not new. Identification Friend and Foe (IFF) has been an ongoing concern and subject of many projects for all. IFF is, however, mostly used in major assets that are capable of tracking and identifying other targets with reasonably ample time to react. The current system contemplated is concerned mainly with primary delivery weapons systems that lack such abilities. Such weapons usually have a very narrow active operational window within which the intended target can react.

Under the system contemplated, we solve the problem of sorting which parties are sending the signals by having the friendly weapons prepared before they become operational so that the weapons send different types of signals. This preparation can be done on site, physically (manually or automatically by support systems like launchers), or in remote sites by various communication systems.

In light of the aforementioned the following system is proposed:

One major component of the system is a resident, self-defeat unit that is installed in all primary delivery weapons systems (RSD unit-resident, self-defeat—or screamer). Another is a conditioning, arming and preparation unit (CAP unit-conditioning, arming, and preparation—or preparer). Another is an interpreter, an instructor transceiver unit at a friendly site receives and interprets signals from the screamers and sends instructions to self-defeat if necessary (RII unit-receive, interpret, and instruct—or instructor). It is the instructor's job to defend friendly assets. Another component contemplated is a special instructor whose job is to send query, data and instructions to, and receive data from, the screamers, and manages the database of the individual screamers remotely (RSM unit-receive, send and manage—or manager). The supporting battle management systems (BMS) communicate with the instructors.

The screamers (RSDs) primary function is to broadcast predefined, coded signals once the weapon becomes operational, and be ready to receive instructions. Toward a successful end, a screamer needs to function in many roles. First, it should be able to recognize the operational state of the weapons systems in which it resides. Next, once the weapon becomes operational, the screamer should be able to determine accurately whether it was prepared beforehand by a friendly party or not. In other words, to prevent accidental engagement of the self-defeat mechanism, the screamer on friendly weapons needs to broadcast a different type of signal once it becomes active. It also means that the screamer can receive instructions in a secure manner so that the hostile party can not do the same.

This instruction can be done by a combination of the hardware and software keys, automatically or manually. If not prepared (therefore, it is the hostile party that is firing the weapon), and when an instruction to self-defeat is received and authenticated, it will then perform the necessary function defined as the self-defeat mechanism in a number of predetermined ways.

Besides these functions, there are many other conceivable capabilities that are needed to enhance the capabilities of the present invention. One such capability is to provide a tamper-proof system for the screamer hardware and/or software. This would be needed even if the proposed system is to be kept secret because there is always a chance that procurement of such a system having a self-defeat mechanism may be known, therefore a need exists to be prepared for such a contingency in order to prevent, frustrate and make prohibitively expensive for an adversary to tamper with the self-defeat mechanism.

Further functions can be implemented to maximum the benefits. One such function is its ability to be awakened and instructed and to be made to respond. This can also be integrated with GPS capabilities so that its location can be known to itself and be transmitted when instructed.

A screamer draws necessary operational information from its own database so that it can send correct signals as well as authenticate information received. The database can hold such information as encryption data, weapons specifications, manufacturing data, sales data, instruction routines, GPS location, data on the preparer that prepared it, and self-defeat mode routines.

If negating hostile action was the only concern, screamers on friendly weapons can just be kept quiet so that only the hostile weapons will "scream". But this system also proposes preventing damages from friendly fire. This necessitates that the screamers both on the friendly as well as on the hostile weapons need to broadcast. The friendly forces then need to distinguish the signals sent by the screamers and take appropriate actions. Hostile signals will usually be acted on immediately so that the hostile weapons will be defeated as soon as possible. On the other hand, friendly signals need to be treated in a more elaborate way because of the need to discern whether the weapon is on its way to the enemy or taking an errant detour to a friendly party.

This process of discerning a friendly weapon's operational status is engaging. The "instructor" may have to interrogate the weapon as to its destination, if determined, as well as vector, location and flight history information. Any information gained from such an interrogation needs to be processed rapidly against its own database for rapid reaction when necessary. In the terminal phase defense, a friendly party can also employ a proximity detonator that will trigger the self-defeat mechanism if any friendly weapons come too close to the friendly location regardless of the weapon's intention.

As mentioned earlier, it has to be the offending weapon in an operational stage that must broadcast most of the time. Friendly parties need to be hidden in all aspect as much as possible. But, since this system is to be kept a secret itself, any broadcast by these weapons in operations must be guarded so as to avoid detection from the hostile, host party. This eliminates the possibility of using normal, constant broadcasting at high intensity. A more, stealthier method must be used such as using intermittent, high frequency spurts. Such a discrete broadcasting method needs to be adopted by all the components of this system. Besides EM Broadcast, underwater acoustical signals need to be treated separately.

Self-defeat mode includes self-destruction by detonation, where the detonation can be achieved by a host warhead or by a separate charge introduced for this purpose. However, the self-defeat mode can employ a number of other options to maximize and optimize the outcome of the result. The self-defeat mode thus becomes a part of the friendly party's options managed with the help of the battle management systems. Where it is undesirable, detonation can be suppressed. A guidance system, for example, can be instructed to veer off course to a harmless location. If possible, the guidance system can also be instructed to double back and detonate at its original launch site. Or, the guidance system can be fed with a new targeting information on a hostile site. The Self-defeat function will also include contingency routines against tampering with the hardware. Any detection of tampering physically or by bogus instructions may result in any number of actions including immediate self-destruction.

Conditioning, arming and preparation of weapons systems and the resident screamers is the essential step of the current system proposed. This is what makes a weapon a friendly one. The preparation can be as simple as giving a pre-selected instruction. This usually takes a specialized hardware to be connected with a weapon under preparation. This hardware, "preparer", is then establishes a communication with the screamer on board, and gives requisite instructions. In a way, a preparer is a user interface between the operators and the weapons. This preparer can be a small hand-held device that is used manually on small arms. In some cases, a preparer can be managed by larger weapons systems automatically. A preparer can be incorporated into a missile launcher onboard a ship or a fighter, where the preparer is, in turn, connected to a local combat management system. A preparer can be made to be weapons specific, or universal to some degree.

A preparer will use both hardware keys and software keys for security. A hardware key would be necessary to be correctly installed and connected with a screamer in a weapon. A series of software keys are then presented to the screamer in a set routine to authenticate the user before instructions and data can be fed.

As much as any weapons can be stolen and used against a friendly party, preparers can be stolen and used to prepare hostile weapons as friendly ones. Once such illicit preparations are made, there are no defensive measures against those weapons. However, once such a loss of preparers are known, measures can be taken so that the signals sent by those screamers can be identified as hostile. To this end, the data fed into screamers must also include information on the types of preparers together with other information such as date prepared location of preparation, and ID numbers of the preparers.

One preventive measure that can be taken against such a theft is to give the preparers means to at least listen and receive instructions, identify and recognize that such instructions are for them, and take measures so that further use of such preparers will prepare the weapons wrong way. Another way is to make it necessary to "appease" the preparers regularly in a set manner. Depriving such a regular reassurance will make the preparers malfunctioning. Preparers can also be made to be activated with a use of their own hardware and software keys.

An "instructor's" main job is to listen to any "screaming" issued by a screamer, identify the nature of the scream, and take necessary measure. An instructor needs to do this in a secure and discrete manner. It is also an instructor's job to collect data from interpreting such screams and send the data to a local battle management system. An instructor also communicates with a number of such battle or combat management systems and updates its own data as well as instructions on how to react.

The database of an instructor is significantly more vast than one in a screamer. An instructor needs all of the currently operational instructions given to screamers, friendly or otherwise. It also needs to see all data given to all screamers. It must have on hand all the instructions to react to any number of these screamers, where the instructions can change continuously on site by a number of local battle management systems for optimum outcome compliant to a number of directives, parameters and strategies.

On hearing "screams" and once interpretation and authentication is made, an instructor needs to communicate with the originating screamer. Only then an instructor broadcasts, and does it ever so discretely. Besides that, the duration of such a broadcast needs to be shortened as much as possible to reduce the window of possible detection. The communication itself needs to be secured to prevent interception and interpretation by a third party, friendly or hostile, as well as to prevent a possible tampering.

Before a secure communication link can be established, any such a communication will be proceeded by an authentication process not only in the initial phase of the establishment of communication, but also in the intermediate steps. An authentication protocol leads a batch of data or instructions in a signal spurt.

Depending on the state of battle as seen by an instructor or a local battle management system, a need may arise to acquire more information that a screamer can provide. Initially, a screamer would provide a set of minimum data deemed important and critical out of its own database. Once the need and the scope to acquire more data from the screamer's database are decided, an instructor will issue a query signal to (interrogate) the screamer, to which the screamer is programmed to respond. It is, then, the instructor's job to interpret and process the data, some of which will be given to the local battle management system.

An instructor may also be incorporated with other self-defense systems designed against weapons systems lacking screamers. One such a self-defense system can be a series of jamming devices. It can also be teamed with anti-missile missile systems and other projectile systems designed against missile threats such as the ship-borne Phalanx Guns. In the future, other systems such as laser guns and directed weapons systems can also be combined. Such other means of self-defense are the only option left to an instructor when a screamer in a hostile or an errant friendly weapon malfunctions.

A manager does all the jobs (except listening) that an instructor does and some more. A manager is not concerned with a protection of a particular friendly site. Its primary function is to query and manage the database of all screamers that are residing in weapons systems deployed, but have gone operational. A manager may issue its own instructions at a strategical level as compares to an instructor's instructions at a tactical level. A manager gathers valuable information from the queries and interrogations it performs against the screamers. It is also a manager's job to prepare and update the screamers up until they become operational, from which point any number of instructors can take over.

One possible example of a manager's job can be explained in a case when a friendly nation turns into a hostile one, and about to, or likely to, initiate an engagement in which weapons acquired from friendly side are likely to be used. In this case, if it is decided that a certain types of such weapons are deemed to be necessary to be rendered harmless before a conflict occurs, a manager will issue set instructions defining the parameters that will accurately define such weapons systems that need to be decommissioned. The parameters may include types, manufactured dates, sales data as well as GPS coordinates that define the geographical boundaries, if any.

A primary object of the present invention is to provide protection to friendly assets in combat situations.

Another object of the present invention is to provide means for identifying friendly and hostile weapons in action.

Yet another object of the present invention is to provide secure means for communications between various subsystems.

Still yet another object of the present invention is to provide ways to secure such communications.

Another object of the present invention is to provide self-defeat measures to primary delivery weapons in cases where they are acquired and used by hostile parties.

Yet another object of the present invention is to provide means to build and utilize various forms of databases.

Still yet another object of the present invention is to provide various additional tactical and strategical options utilizing the current system for maximum benefit.

Additional objects of the present invention will appear as the description proceeds.

The present invention overcomes the shortcomings of the prior art by providing additional means to identify and counter hostile primary delivery weapons systems in use that have been manufactured and delivered to other parties.

The foregoing and other objects and advantages will appear from the description to follow. In the description, reference is made to the accompanying drawing, which forms a part hereof, and in which is shown, by way of the illustration, specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

LIST OF REFERENCE NUMERALS UTILIZED IN THE DRAWINGS

10 friendly fire avoidance/self-defense system
12 assets
14 primary weapon
16 weapon transmission
18 self-defeat transmission
20 satellite
22 instructor unit
26 resident self-defeat mechanism (RSD)
28 conditioning, arming and preparation unit (CAP)
30 receive, interpret, and instruct unit (RII)
32 receive, send and manage unit (RSM)
34 battle management system (BMS)
36 other self-defense systems
40 RSD standby
42 RSD transcieve
44 RSD communications
46 RSD authentication
48 RSD database management
50 RSD internal monitoring
52 flight management
54 RSD GPS receive
56 RSD preparation download
58 interrogation response
60 RSD discrete screaming
62 RSD self defeat mechanism
64 CAP hardware key
66 CAP software key
68 CAP GPS receiver
70 CAP data management
72 CAP secure download
74 CAP secure upload
76 CAP arming
78 CAP security authentification
80 CAP security monitoring
82 RII standby
84 RII transcieve
86 RII secure communications
88 RII security authentification
90 II database management
92 RII interrogation
94 RII instruction
96 RII interaction with battle management system

98 RII interaction with other self-defense systems
100 RSM transcieve
102 RSM communications
104 RSM authentification
106 RSM database management
108 RSM interrogation
110 RSM instruction
112 RSM interaction with battle management system
114 Arming sequence having an RSD unit
116 communication sequence between and RSD and RII

BRIEF DESCRIPTION OF THE DRAWING FIGURES

In order that the invention may be more fully understood, it will now be described, by way of example, with reference to the accompanying drawing in which.

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Figure 1:
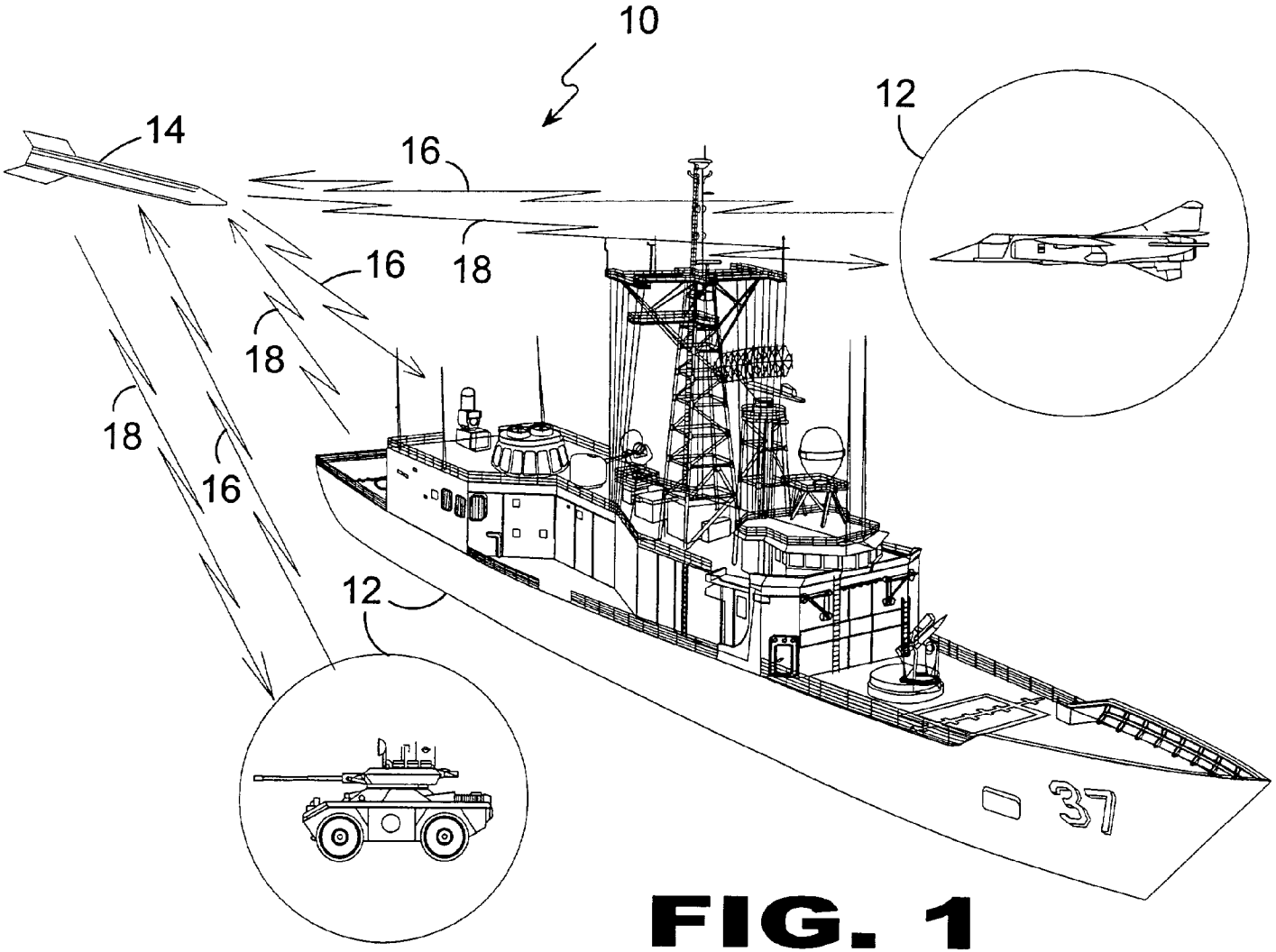
FIG. 1 is an illustrative view of assets that can be defended by the current system.

The friendly fire avoidance/self-defense system 10 is illustrated in FIG. 1 showing secondary weapons platforms, from which various primary weapons can be launched, that can be defended by using the current system 10. The assets 12 having means for receiving transmission 16 from weapon 14 and selectively generating transmission 18 to defeat the functioning of weapon 14 manufactured by the same party manufacturing assets 12. The transmission of the disabling transmission can be generated from the actual asset 12.

Figure 2:
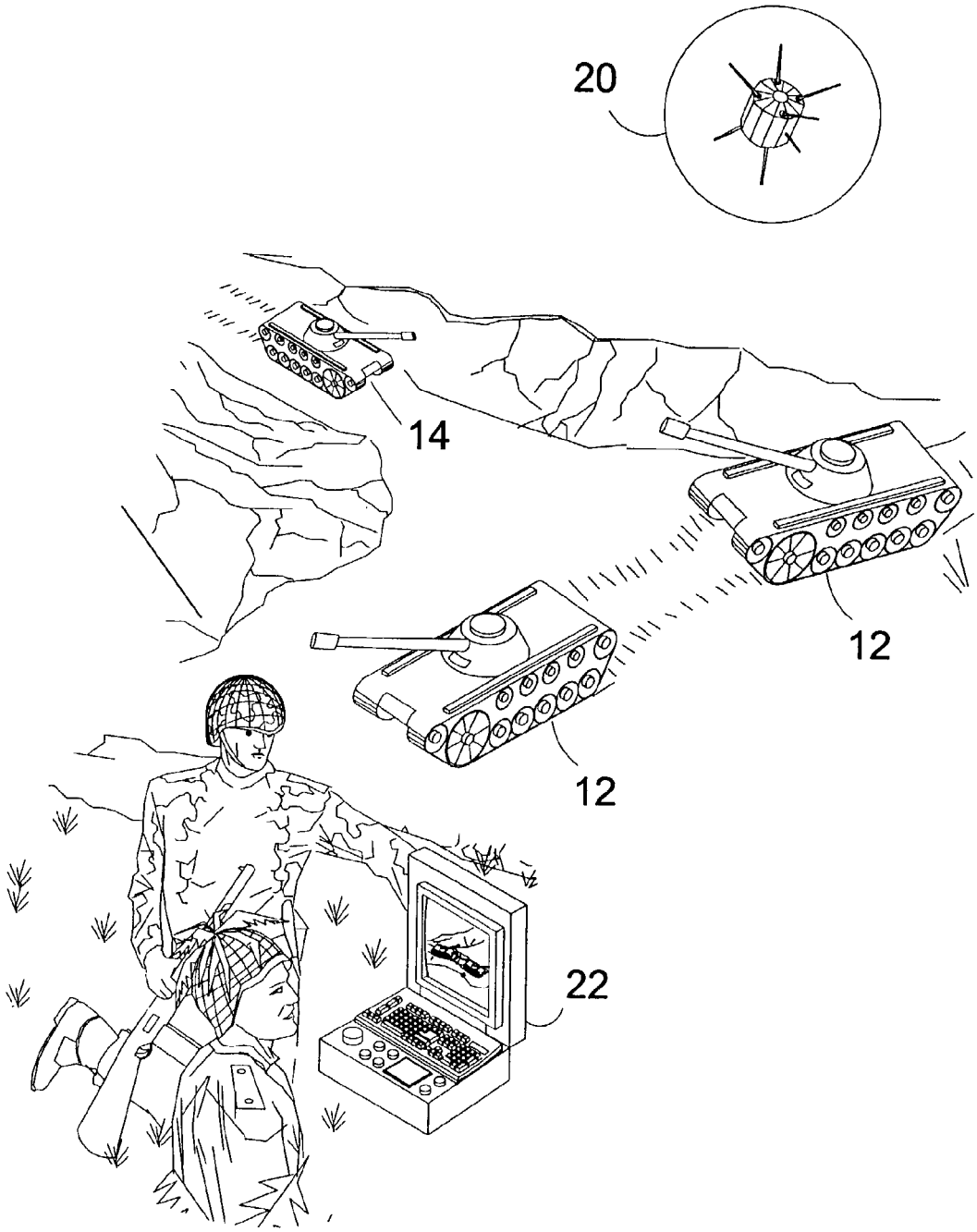
FIG. 2 is another illustrative view of a tactical situation in which the current system is in use.

Referring to FIG. 2, shown is a tactical situation in which the current system 10 having an instructor component unit 22 of the current system being manned by soldiers in a tactical engagement to protect friendly assets 12. Secure communications can be carried with the aid of the satellite 20.

Figure 3:
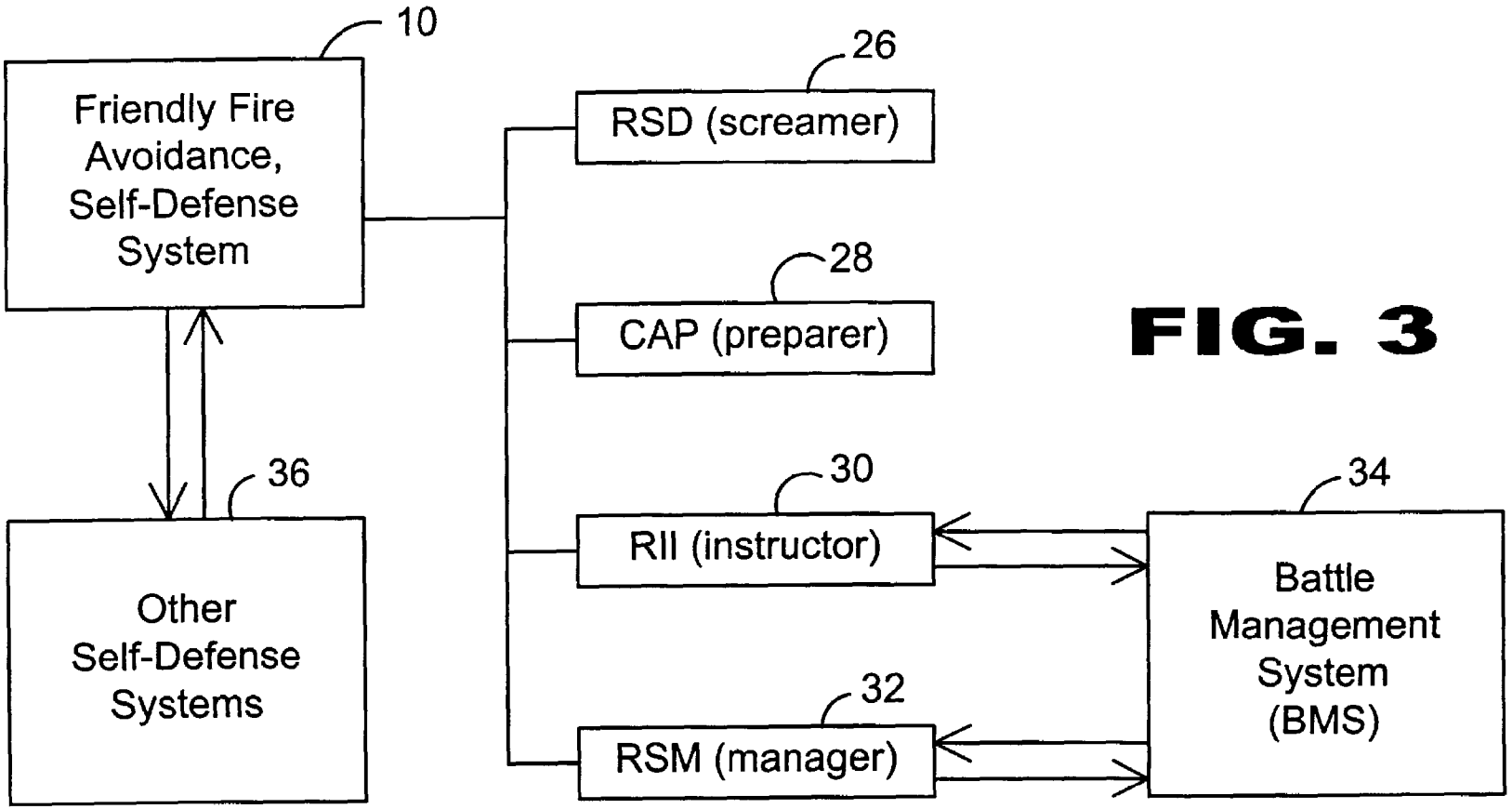
FIG. 3 is a diagram of the components of the friendly fire avoidance, self-defense system.

Referring to FIG. 3, shown is a diagram of the components of the friendly fire avoidance, self-defense system 10. The system 10 has four major components comprised of a resident self-defeat mechanism (RSD) 26; a conditioning, arming and preparation unit (CAP) 28; a receive, interpret, and instruct system (RII) 30 and a receive, send and manage system (RSM) 32 that can work in conjunction with other self-defense systems 36 to for a cohesive battle management system 34.

Figure 4:
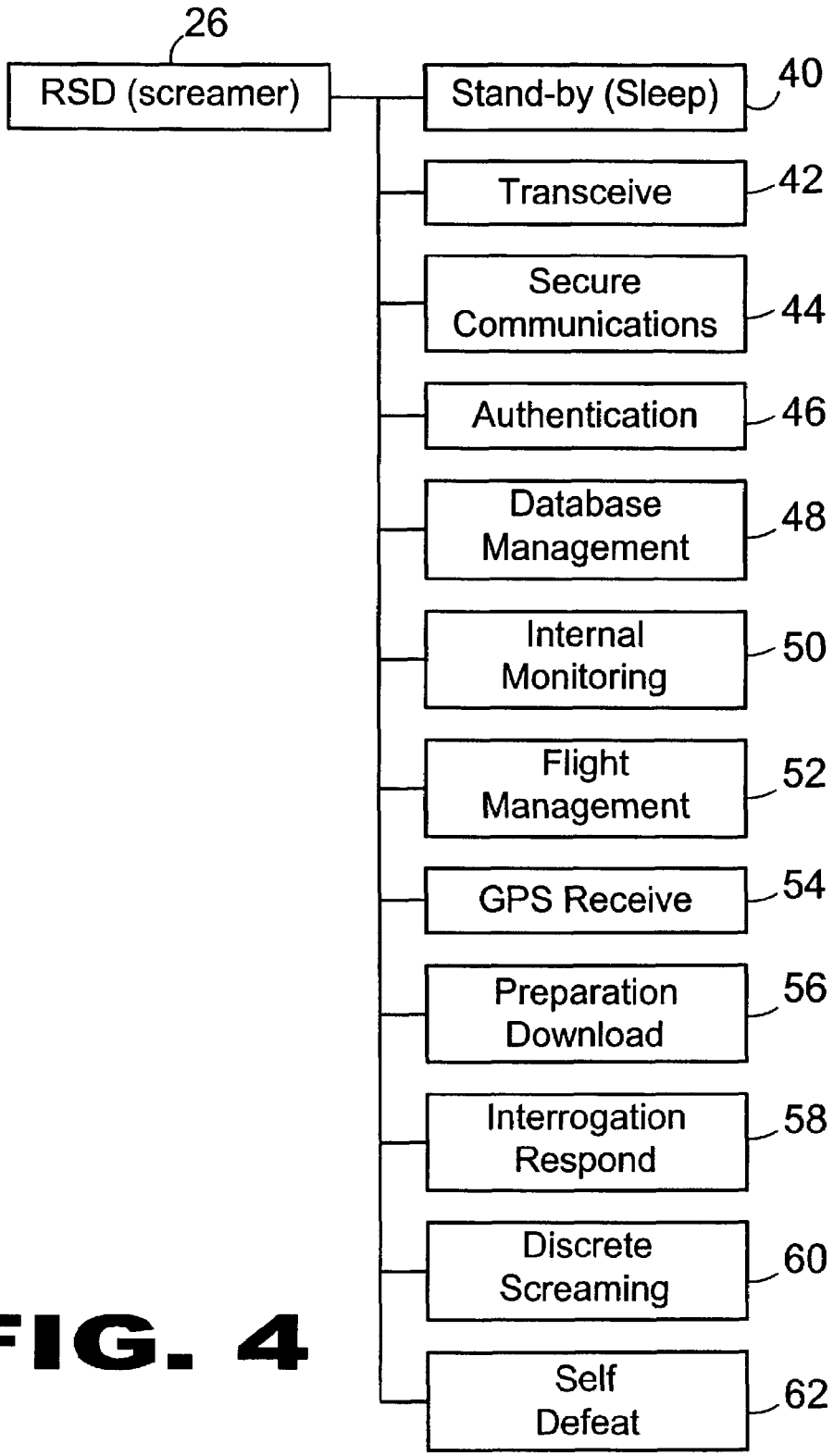
FIG. 4 is a diagram of the functions of a screamer.

Referring to FIG. 4, shown is a diagram of the functions of an RSD system 26. The RSD system has a normal state of standby 40. Once the RSD system is engaged, it starts transmitting predefined coded identification and listening for response 42. The transmission is encrypted to prevent tampering 44. Upon receiving a response the RSD system authenticates the response 46 and retrieves the necessary data 48 to initiate the self-defeat mechanism 62. A further function of the RSD system would be an internal monitoring whereby the system can determine what type of system it is, whether it a friend or foe system 50. If the RSD system has received a self-defeat transmission it may incorporate a deviance in the flight management circuitry 52. The system may also need to determine trajectory therefore a GPS receiver 54 would be incorporated to determine the trajectory path. If the weapon is to be instructed on-site then the RSD system would be interfaced with the CAP unit 56 which would require an interrogation response 60.

Figure 5:
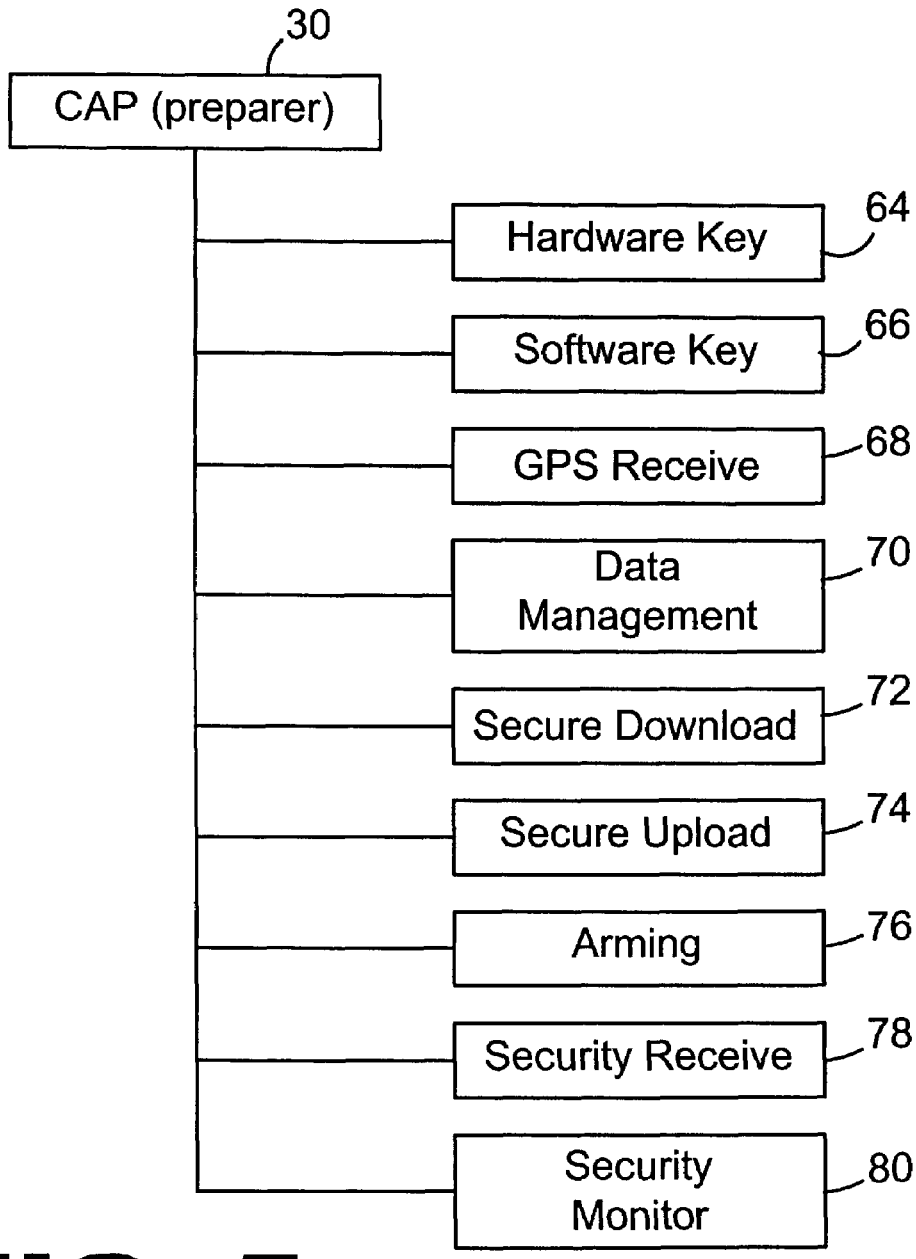
FIG. 5 is a diagram of the functions of a preparer.

Referring to FIG. 5, shown is a diagram of the functions of the conditioning, arming and preparation unit CAP 28. The CAP process can involve a password protected entry to arm the weapon. The password protected entry can be comprised of a hardware key 64 and/or a software key 66. It may also be necessary to download GPS data and/or onboard data management routines. Any process involving the arming 76 or modification to the existing system would require means for downloading 72 and uploading 74 using the aforementioned hardware 64 and/or software keys 66. To prevent the unauthorized access or use of ca CAP unit, the unit would need the capability to discern a valid modification verse tampering. Therefore the system would monitor itself 80.

Figure 6:
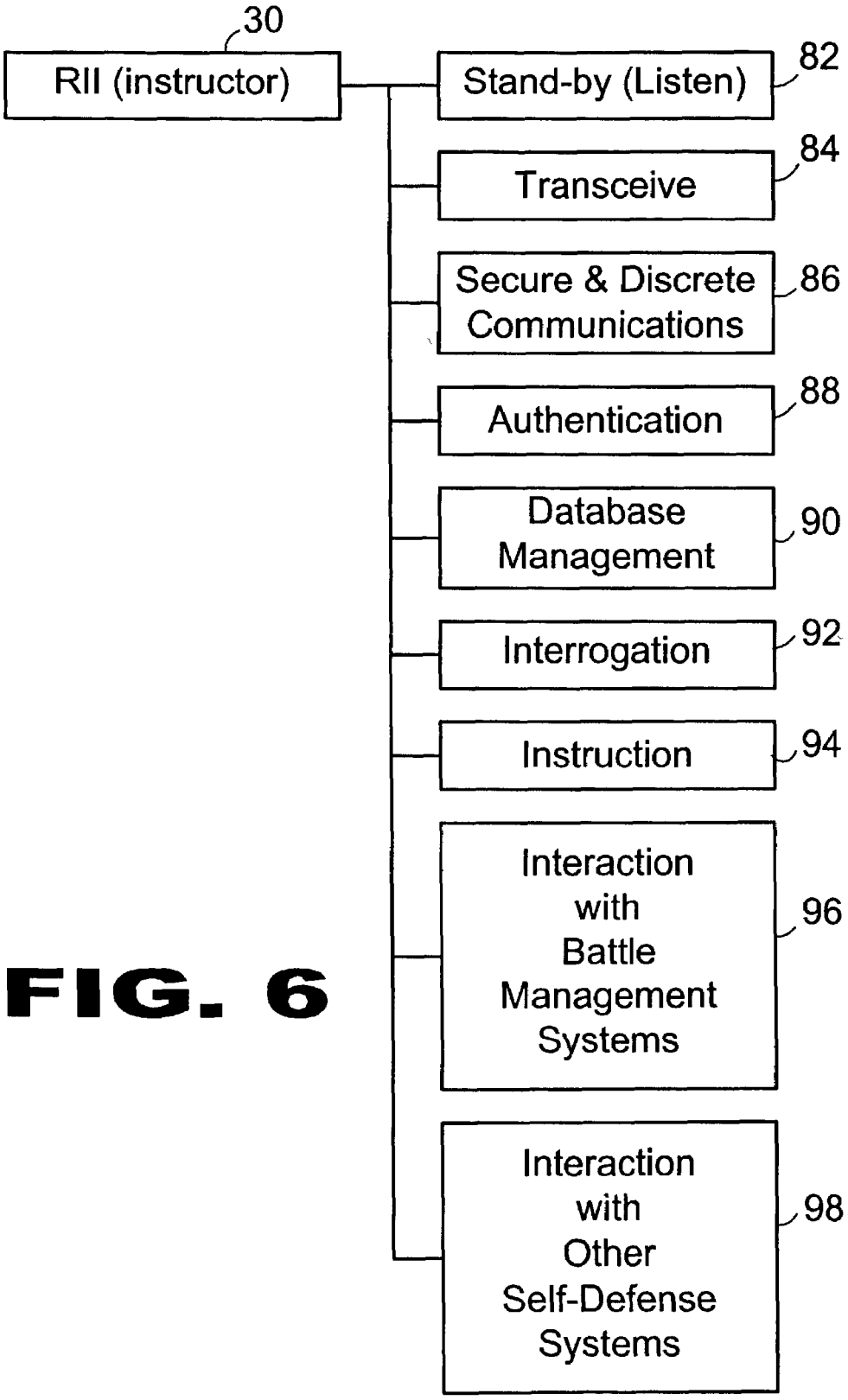
FIG. 6 is a diagram of the functions of an instructor.

Referring to FIG. 6, shown is a diagram of the functions of the receive, interpret and instruct unit (RII) 30. The main function if the unit is to listen 82 for transmissions from RSD units. The RII unit need to discern friendly RSD transmissions from unfriendly transmissions 84 and communicate an appropriate response 86 through a predetermined secure protocol. The database 90 of an instructor is significantly more vast than the RSD database. An instructor needs all of the currently operational instructions given to RSD units, friendly or otherwise. It must have on hand all the instructions to react to any number of RSD units, where the instructions can change continuously on site by a number of local battle management systems for optimum outcome compliant to a number of directives, parameters and strategies. The need may arise to acquire more information from an RSD unit. Initially, an RSD unit would provide a set of minimum data deemed important and critical out of its own database. Once the need and the scope to acquire more data from the RSD unit is determined the RII 30 will interrogate 92, 94 the RSD unit and process the data, some of which will be given to the local battle management system 96 and/or other self-defense systems 98.

Figure 7:
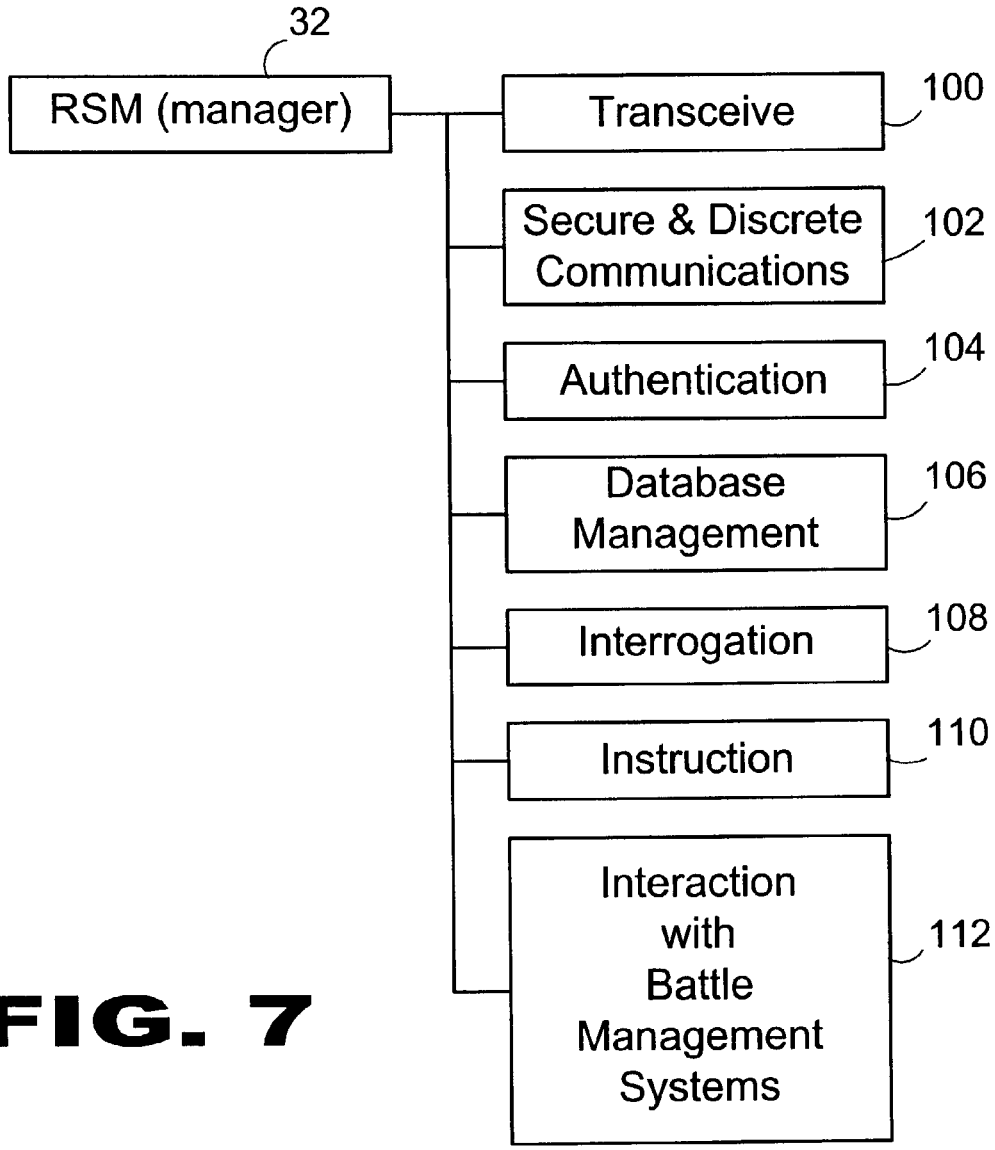
FIG. 7 is a diagram of the functions of a manager.

Referring to FIG. 7, shown is a diagram of the functions of the receive, send and manage unit (RSM) 32 which performs all of the functions of an RII unit 30 without listening for RSD transmissions. The primary function of the RSM unit is to monitor operational RSD units 100. A manager may issue its own instructions 102 at a strategical level as compares to an instructor's instructions at a tactical level. A manager gathers valuable information from the queries, interrogations 108 and instructions 110 it performs against the RSD units and transmits the database information 106 to the battle management system 112.

Figure 8:
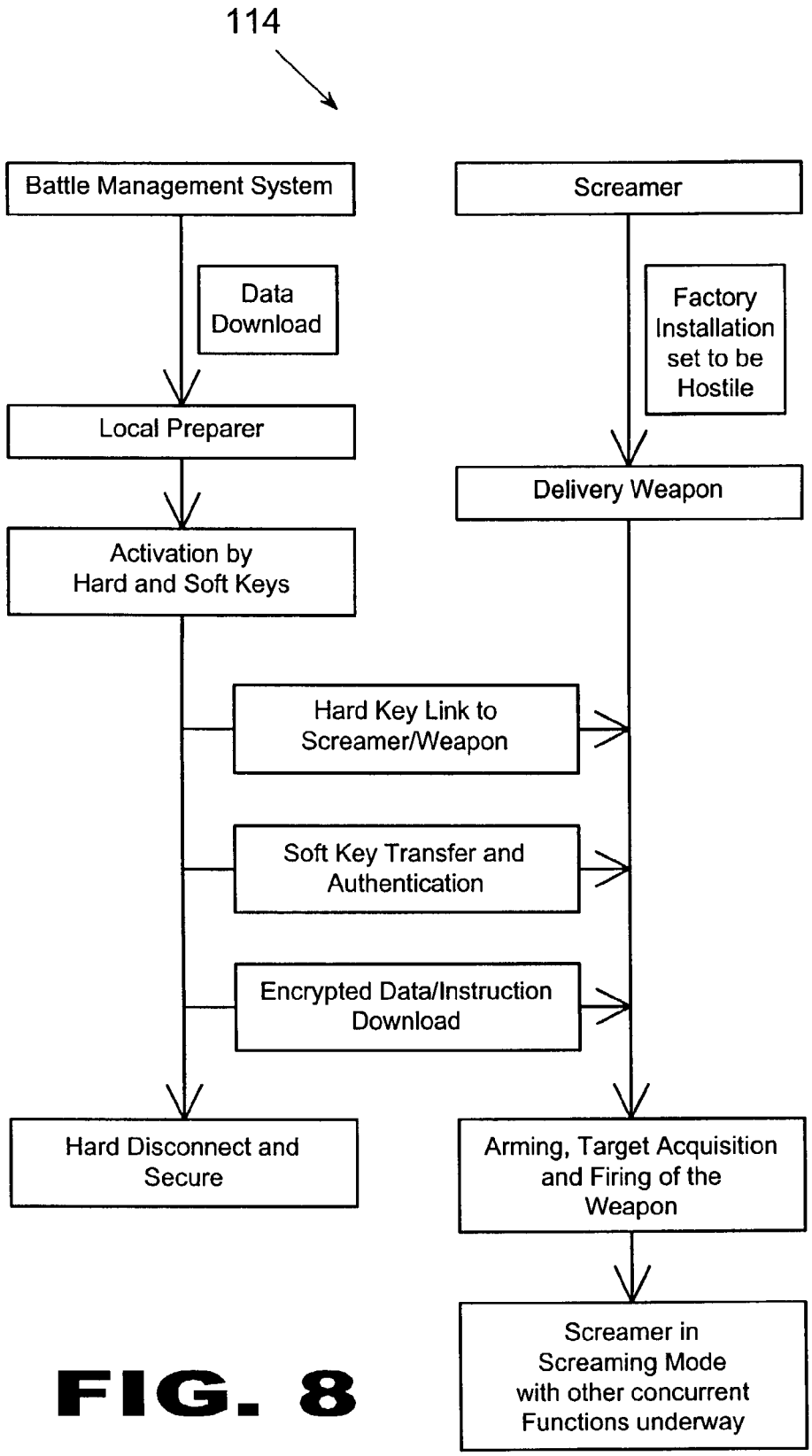
FIG. 8 is a diagram of a general arming procedure of a friendly weapon with a screamer.

Referring to FIG. 8, shown is a diagram of a general arming procedures of a friendly weapon having an RSD unit.

The system can be armed in two way either using a battle management system 34 or onsite at the factory. The battle management system is used primarily on-site using a CAP unit 28. The factory installed setting is normal hostile since these weapons are shipped to third party friendlies.

The RSD unit's primary function is to broadcast predefined, coded signals once the weapon becomes operational, and be ready to receive instructions.

This instruction can be done by a combination of the hardware and software keys, automatically or manually. If not prepared (therefore, it is the hostile party that is firing the weapon), and when an instruction to self-defeat is received and authenticated, it will then perform the necessary function defined as the self-defeat mechanism.

Figure 9:
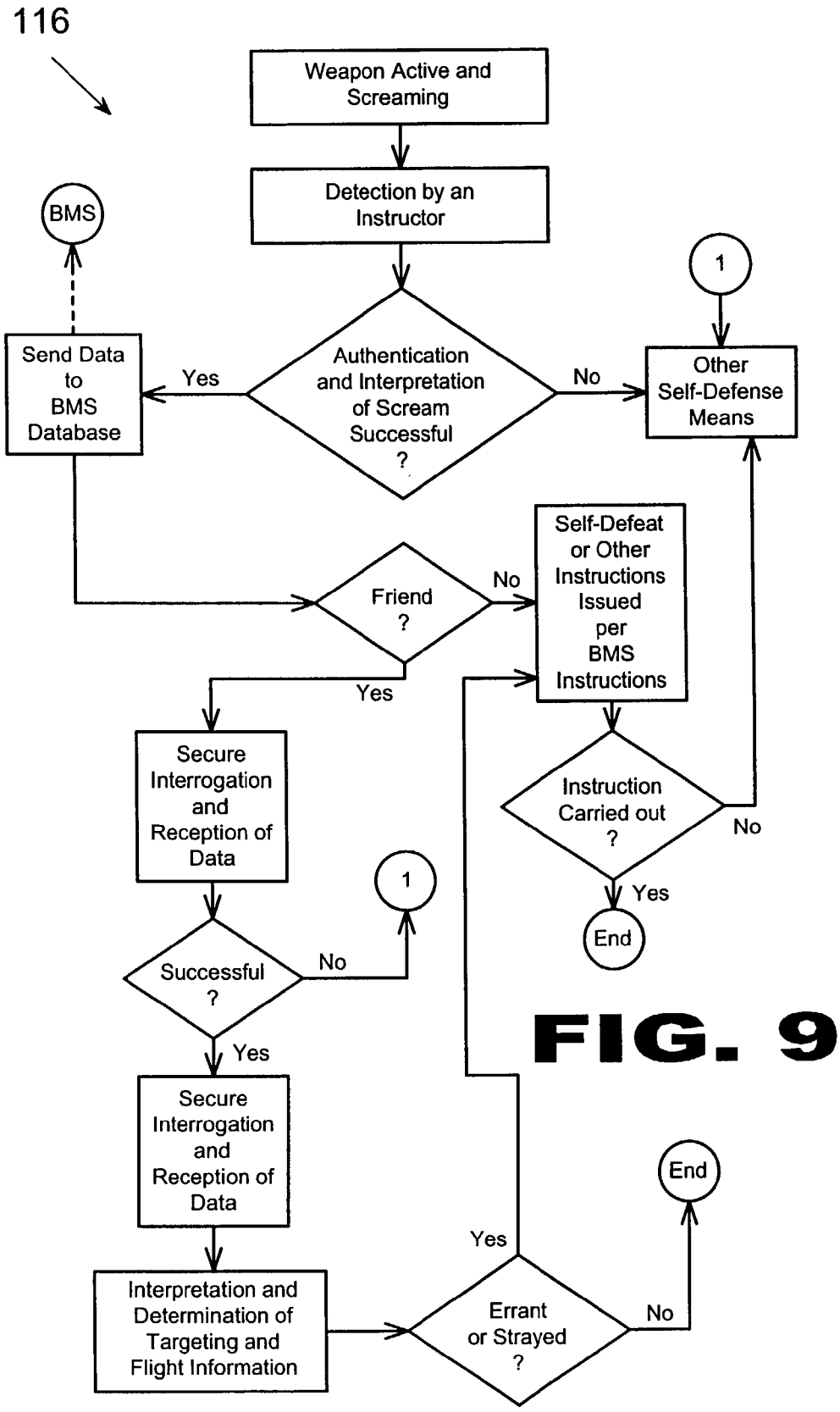
FIG. 9 is a diagram of a general interception procedure by an instructor.

Referring to FIG. 9, shown is a flowchart of a general interception procedure by an instructor. The diagram shows an example of an interception of a friendly or hostile weapon by an instructor. This process of discerning a friendly weapon's operational status is comprised of receiving identification information to determine the original status of the weapon. An RII unit may have to interrogate the weapon as to its destination, as well as vector, location and flight history information. Any information gained from such an interrogation needs to be processed rapidly against its own database for rapid reaction when necessary. In the terminal phase defense, a friendly party can also employ a proximity detonator that will trigger the self-defeat mechanism if any friendly weapons come too close to the friendly location regardless of the weapon's intention.

Self-defeat mode includes self-destruction by detonation, where the detonation can be achieved by a host warhead or by a separate charge introduced for this purpose. However, the self-defeat mode can employ a number of other options to maximize and optimize the outcome of the result. The self-defeat mode thus becomes a part of the friendly party's options managed with the help of the battle management systems. Where it is undesirable, detonation can be suppressed. A guidance system, for example, can be instructed to veer off course to a harmless location. If possible, the guidance system can also be instructed to double back and detonate at its original launch site. Or, the guidance system can be fed with a new targeting information on a hostile site. The Self-defeat function will also include contingency routines against tampering with the hardware. Any detection of tampering physically or by bogus instructions may result in any number of actions including immediate self-destruction.

What is claimed is:

1. A friendly fire avoidance system for engaging disabling electronic components within an operational weapon to disable or destroy said weapon comprising:

a) a self-defeating electronic system in said operational weapon including:

i) a first processor;

ii) a first transmitter for transmitting a signal identifying the system incorporated thereon;

iii) a first receiver for receiving a signal transmitted from a second transmitter for engaging the incorporated self-defeating electronic system;

iv) a self-defeat mechanism;

v) means connected to said first processor for engaging the self-defeat mechanism; and b) a remote electronic system distant from said operational weapon for analyzing the received transmission from said first transmitter in said operational weapon including;

i) a second processor;

ii) said second transmitter transmitting the signal to said first processor for engaging the self-defeating mechanism;

iii) a second receiver for receiving a signal transmitted by said first transmitter containing information identifying said first processor and a trajectory of said operational weapon;

iv) a trajectory analyzer to determine whether the operational weapon is on an intercept course with friendly assets; and v) a database containing codes to be transmitted to said first processor to engage said self-defeat mechanism.

2. The friendly fire avoidance system as recited in claim 1, further comprising a CAP unit for conditioning, arming and preparing a weapon having self-defeating mechanism (RSD unit) therein.

3. The friendly fire avoidance system as recited in claim 1, further comprising a RSM unit for receiving, sending and managing a plurality of RSD units.

4. The friendly fire avoidance system as recited in claim 2, wherein the CAP unit has a hardware key and a software key providing a secure means for arming said weapon.

5. The friendly fire avoidance system as recited in claim 3, wherein the RSM unit has means for managing and communicating with a plurality of RSM units.

6. The friendly fire avoidance system as recited in claim 5, wherein the RSM unit has means for communicating with a battle management system.

7. The friendly fire avoidance system as recited in claim 6, wherein the RSM unit has means for receiving instructions from said battle management system.

8. The friendly fire avoidance system as recited in claim 7, wherein the RSM unit has means for transmitting the instructions of said battle management system to a plurality of RSD units.

9. The friendly fire avoidance system as recited in claim 8, wherein the RSM unit has means for transmitting a self-defeat sequence to an RSD unit.

10. The friendly fire avoidance system as recited in claim 9, wherein the RSD unit has means for executing the instructions from an RSM unit.

11. The friendly fire avoidance system as recited in claim 10, wherein the RSD unit can interrogate another RSD unit for additional information contained with a RSD unit database.

12. The friendly fire avoidance system as recited in claim 11, wherein the RSD unit has means for selectively initiating based on predetermined parameters the self-defeat mechanism of another RSD unit.

* * * * *